US006556141B2

(12) United States Patent
Ouellette et al.

(10) Patent No.: US 6,556,141 B2
(45) Date of Patent: Apr. 29, 2003

(54) APPARATUS AND METHOD FOR DETECTING THE PRESENCE OF A BURNER FLAME

(75) Inventors: Daniel Ouellette, Montreal (CA); Roland Fabry, Montreal (CA)

(73) Assignee: PIA Procédé Industriel Automatisé Inc., Montreal (CA)

( * ) Notice: Subject to any disclaimer, the term of this patent is extended or adjusted under 35 U.S.C. 154(b) by 3 days.

(21) Appl. No.: 09/853,718

(22) Filed: May 14, 2001

(65) Prior Publication Data

US 2002/0167410 A1 Nov. 14, 2002

(51) Int. Cl.[7] ..... G08B 17/00
(52) U.S. Cl. ..... 340/584; 340/577
(58) Field of Search ..... 340/584, 578, 340/577, 583, 600; 75/375; 266/100; 432/250, 224

(56) References Cited

U.S. PATENT DOCUMENTS

| | | | | |
|---|---|---|---|---|
| 3,476,945 A | * | 11/1969 | Golden et al. | 250/554 |
| 3,594,746 A | * | 7/1971 | Pileika et al. | 340/515 |
| 4,051,375 A | * | 9/1977 | Schuetz et al. | 250/372 |
| 4,855,718 A | * | 8/1989 | Cholin et al. | 340/578 |
| 5,521,697 A | * | 5/1996 | Stavinoha | 250/554 |
| 5,548,277 A | | 8/1996 | Wild | |
| 5,720,604 A | | 2/1998 | Kelly et al. | |
| 6,080,223 A | * | 6/2000 | Mavronis | 75/375 |
| 6,127,932 A | * | 10/2000 | Wilson et al. | 340/578 |
| 6,141,957 A | | 11/2000 | Tsukagoshi et al. | |

* cited by examiner

*Primary Examiner*—Daniel J. Wu
*Assistant Examiner*—Son Tang
(74) *Attorney, Agent, or Firm*—Ogilvy Renault; James Angelhart

(57) ABSTRACT

An apparatus for flameout detection to be used with a furnace having a sight hole tube for inspection of a flame. The apparatus comprises a fixed portion adapted for being mounted to the sight hole tube and being electrically connected to a control system. The fixed portion defines a first see-through channel being positioned opposite a sight hole of the sight hole tube, whereby the flame is visible therethrough. A detachable portion has a sensor device disposed therein a second see-through channel. The detachable portion is releasably mounted to the fixed portion such as to engage a contact connection therewith. The sensor device is disposed opposite the first see-through channel of the fixed portion for flameout detection therethrough, wherein the detachable portion is electrically disconnected upon being detached from the fixed portion. A conduit is provided in the fixed portion for injecting air in the sight hole of the furnace, thereby protecting the apparatus from furnace heat exposure through the sight hole. The first see-through channel of the fixed portion and the second see-through channel of the detachable portion are superposed such that the flame is visible through the apparatus.

16 Claims, 2 Drawing Sheets

APPARATUS AND METHOD FOR DETECTING THE PRESENCE OF A BURNER FLAME

BACKGROUND OF THE INVENTION

1. Field of the Invention

The present invention generally relates to an apparatus for flameout detection to be used with furnaces.

2. Description of the Prior Art

Flame detecting apparatuses are commonly used for monitoring burner flames as part of maintaining safe furnace operating conditions. For instance, if fuel is continuously fed to a burner even though the flame has failed to ignite or has become extinguished, an undesirable explosion may result. Thus, flame detecting apparatuses have been used to monitor burner flames and to trigger relays for sounding alarms and cutting off fuel supply in the event of flameouts.

Various types of flame detecting apparatuses have been disclosed in the prior art, with some types enclosed in furnaces and others disposed to the exterior of the furnaces. The internal flame detecting apparatuses are usually proximate to the flame, whereby, in addition to flameout detection, flame intensity can be measured to provide further combustion information. However, the replacement of furnace-enclosed apparatuses involves complicated and/or lengthy procedures which must be followed to prevent hazardous situations.

On the other hand, furnace-external flame detecting apparatuses, though often limited to flameout detection, are more easily accessed. For instance, U.S. Pat. No. 6,127,932, issued to Wilson et al. on Oct. 3, 2000 discloses a sensor disposed at an open end of a closed-end tube. The closed-end tube extends from the exterior of the furnace and reaches the flame. The sensor is concentrically disposed on a circular plate of greater diameter than the tube, whereby the sensor is sealed off from any external light when disposed in the tube so as to only respond to light emitted from the flame. An electrical connection extends from the free surface of the circular plate for connection to an electrical outlet.

U.S. Pat. No. 6,080,223, issued on Jun. 27, 2000 to Mavronis discloses a connection mechanism for securing a flame detecting apparatus to a sight hole of a furnace. The sight hole of the furnace is surrounded by a flange, and resilient arms extend forwardly from the apparatus to exert pressure on the flange, whereby it is secured thereto. Once more, the sensor portion is isolated from any external light. It is noted that an electrical wire extends from a free end of the sensor for connection to an electrical outlet.

Flame detecting apparatuses are exposed to a harsh environment and may need frequent replacing as they are in contact with high temperature surfaces and electromagnetic impulses. One of the advantages of the existing furnace-external flame detecting apparatuses resides in the fact that they are more easily accessed and replaced than internal models. However, the replacement involves disconnecting the apparatuses which may also involve cutting wires. In some instances, it is even required to turn off the furnace to attend the electrical connections.

Also, furnace-external flame detecting apparatuses have been used with furnaces having a pivotable sight hole tube. These sight hole tubes are pivotable such as to be longitudinally aligned with the flame to be inspected, to ensure the flame is visible therethrough. Furthermore, the practice of visually inspecting the flame is common as it may indicate burner problems not detectable by the flame detecting apparatuses. For example, the color of the flame may indicate inefficient combustion. The above described prior art devices do not allow the visual inspection of the flame as they completely seal the sight hole of the furnace to avoid being exposed to external light.

SUMMARY OF THE INVENTION

It is therefore an aim of the present invention to provide an apparatus for flameout detection external to a furnace also allowing flame visibility for alignment of the apparatus and visual inspection.

It is also an aim of the present invention to provide an apparatus for furnace flameout detection having a sensor element detachable from a fixed portion for facilitating the replacement thereof.

It is a still further aim of the present invention to provide a method for replacing a furnace flameout detecting apparatus overcoming the above mentioned disadvantages of the prior art.

Therefore, in accordance with the present invention, there is provided an apparatus for flameout detection to be used with a furnace having a sight hole tube for flame inspection. The apparatus comprises a body adapted for being mounted to the tube. The body has a sensor device being positioned opposite a sight hole of the sight hole tube for flameout detection and has a see-through portion for flame visibility through the apparatus.

Also, still in accordance with the present invention, there is provided an apparatus for flameout detection to be used with a furnace having a sight hole tube for inspection of a flame. The apparatus comprises a fixed portion adapted for being mounted to the sight hole tube and being electrically connected to a control system. The fixed portion defines a first see-through portion being positioned opposite a sight hole of the sight hole tube, whereby the flame is visible therethrough. A detachable portion has a sensor device therein and is releasably mounted to the fixed portion such as to engage a contact connection therewith. The sensor device is disposed opposite the first see-through portion of the fixed portion for flameout detection therethrough, wherein the detachable portion is electrically disconnected upon being detached from the fixed portion.

Further in accordance with the present invention, there is provided a method for installing a flameout detection apparatus to a sight hole tube of a furnace and replacing the flameout detection apparatus. The method comprises the steps of (i) securing a fixed portion of the flameout detection apparatus to the sight hole tube of the furnace, (ii) wiring the fixed portion of the flameout detection apparatus to a control system, (iii) electrically connecting a detachable sensor portion of the flameout detection apparatus by securing same to the fixed portion, (iv) when the detachable sensor portion requires to be replaced, disconnecting the detachable sensor portion by detaching same from the fixed portion, and (v) repeating step (iii) with one of the detachable sensor portion having been repaired and another detachable sensor portion.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
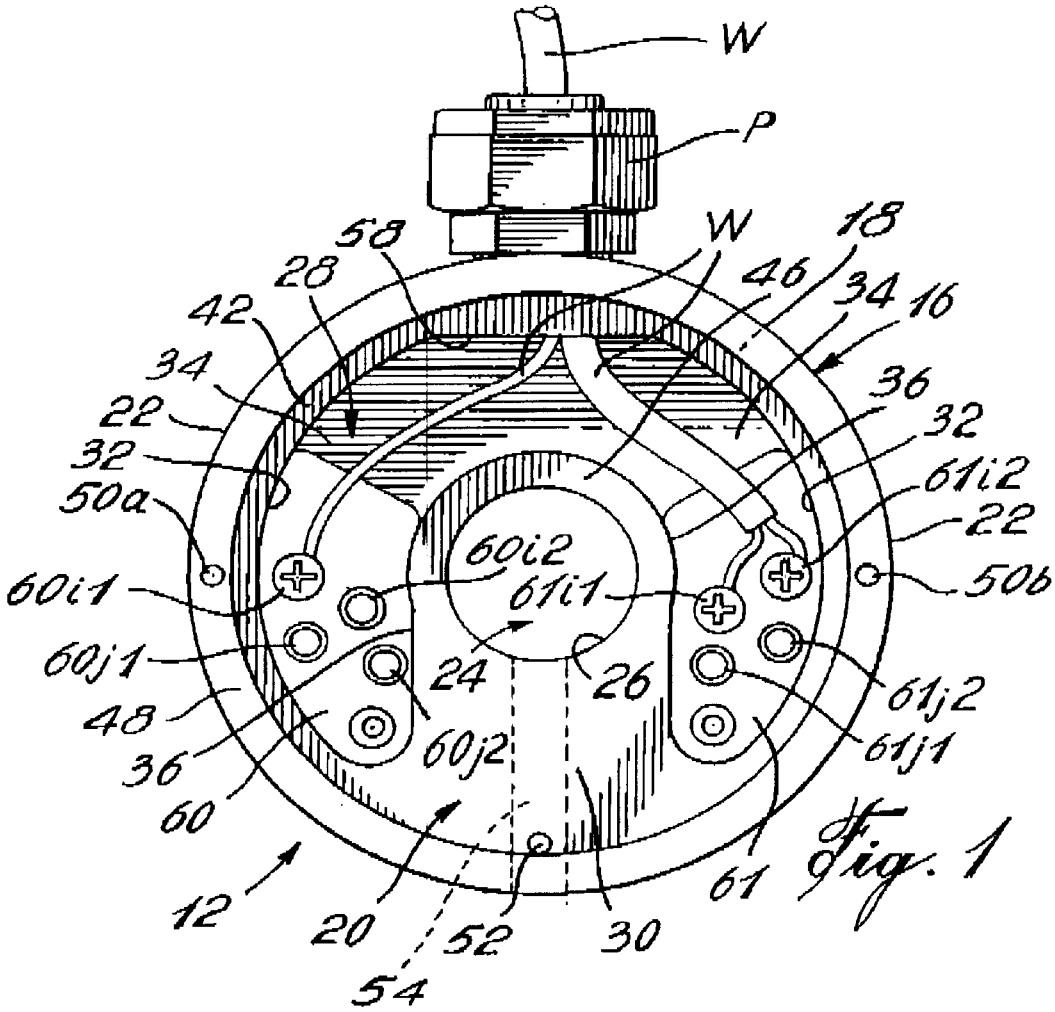
FIG. 1 is a rear elevational view of a fixed member of a flame detecting apparatus in accordance with the present invention.
Figure 2:
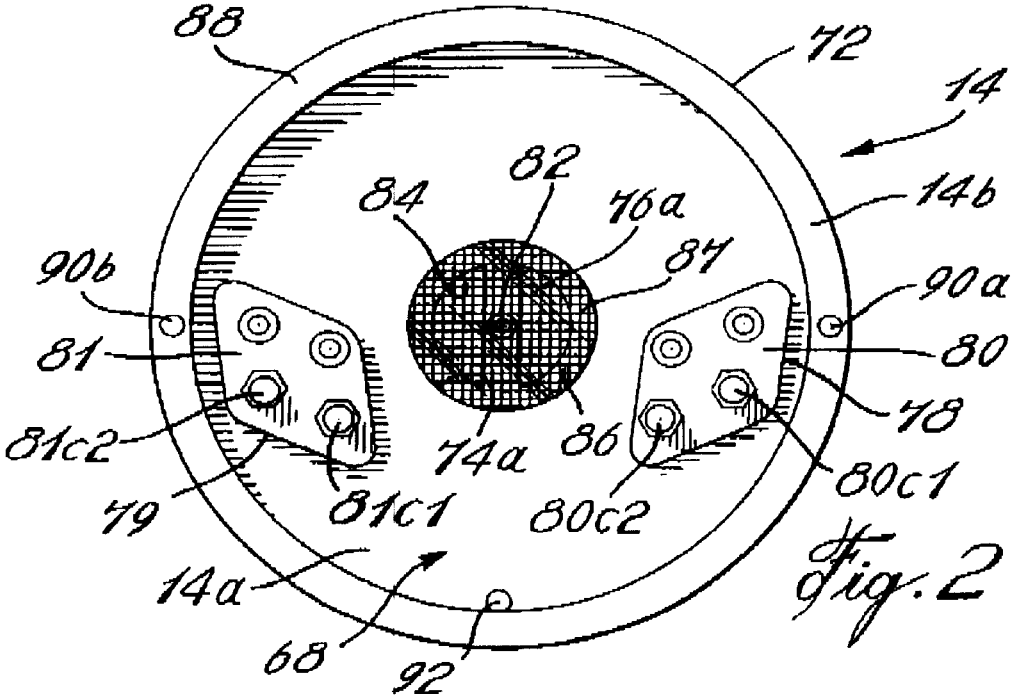
FIG. 2 is a front perspective view of a detachable member of the flame detecting apparatus in accordance with the present invention.
Figure 3:
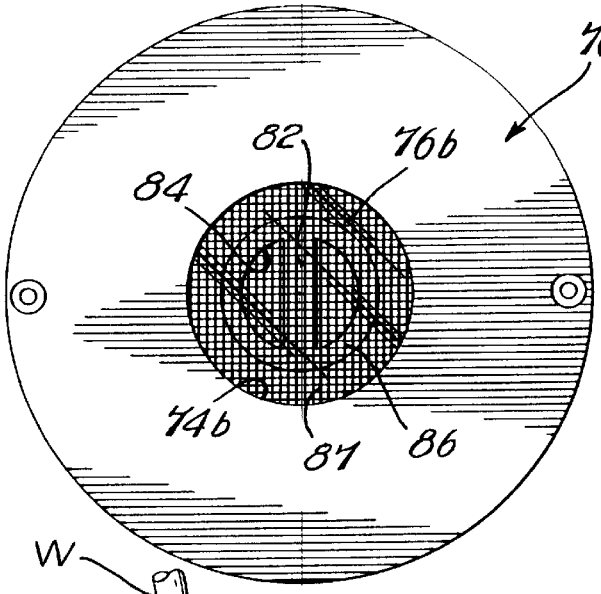
FIG. 3 is a rear perspective view of the detachable member.
Figure 4:
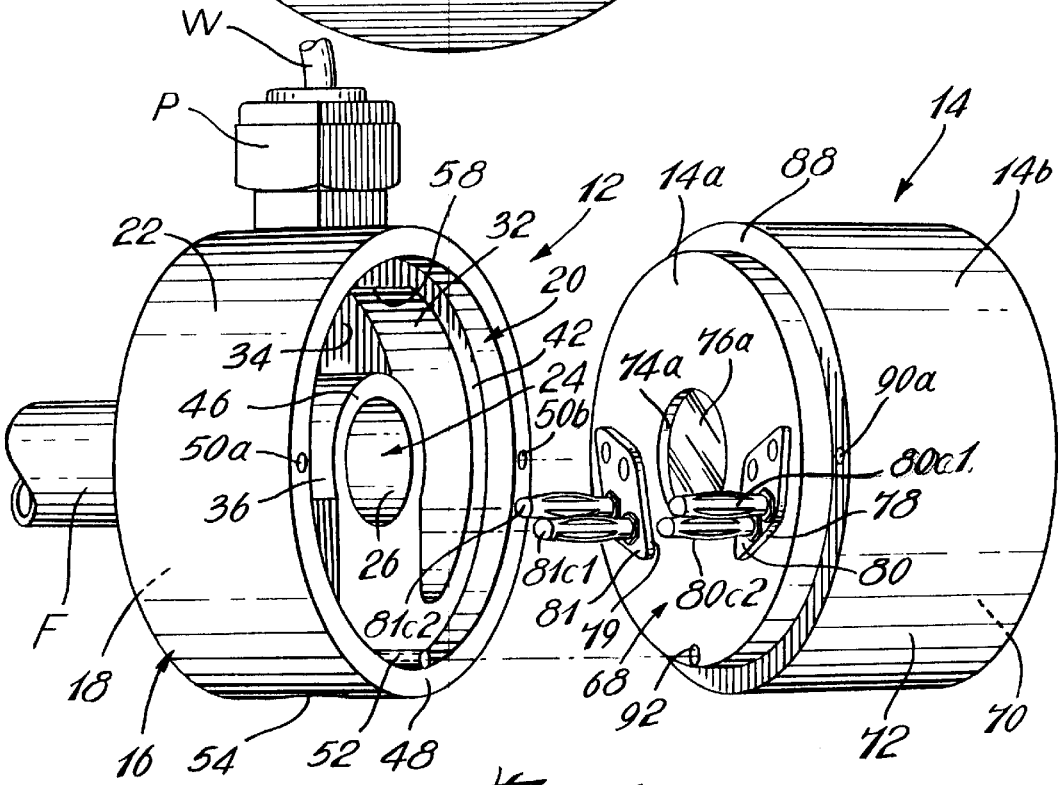
FIG. 4 is a an exploded perspective view of the flame detecting apparatus.

A flame detecting apparatus in accordance with the present invention is comprised of a fixed member 12 and a detachable member 14, shown in FIGS. 1 to 4. Referring to FIGS. 1 and 4 the fixed member 12 has a cylindrical body 16 defined by a circular front surface 18, a circular rear surface 20 and a peripheral surface 22 therebetween. A sight hole 24 extends from the front surface 18 to the rear surface 20 and is generally concentric therewith. The sight hole 24 defines an inner hole surface 26 in the cylindrical body 16. As seen in FIG. 1, the fixed member 12 has an annular cross-section as a result of the sight hole 24 therein.

Still referring to FIG. 1, the cylindrical body 16 has a C-shaped cavity 28 carved in the rear surface 20 thereof. An arm 30 extends from the peripheral surface 22 to the inner hole surface 26, such as to define the C-shape of the cavity 28. The cavity 28 has an outer cavity surface 32, a bottom surface 34 and an inner cavity surface 36. A peripheral wall 42 is defined between the peripheral surface 22 and the outer cavity surface 32. Similarly, a sight hole wall 46 is defined between the inner, hole surface 26 and the inner cavity surface 36.

A flange 48 projects outwardly from the rear surface 20 as an extension of the peripheral surface 22. The flange 48 comprises tapped holes 50*a* and 50*b* disposed therein. An alignment pin 52 extends outwardly from the rear surface 20 and is located on the arm 30, adjacent the flange 48.

As best seen in FIG. 1, an air conduit 54 extends from the peripheral surface 22 to the inner hole surface 26, within the arm 30. The air conduit 54 is adapted for securing a compressed air hose or the like on the side of the peripheral surface 22. For instance, the air conduit 54 may be tapped in order to receive a threaded portion of an air hose adapter (not shown).

An electric wire inlet hole (not shown), wherein a sealing plug P has been mounted, extends from the peripheral surface 22 to the outer cavity surface 32, through the peripheral wall 42. In the preferred embodiment, the electric wire inlet hole 56 is tapped for receiving the sealing plug P therein, through which an electric wire W enters the cavity 28. The peripheral wall 42 comprises a flat portion 58 whereat the electric wire inlet hole is located, such as to be reinforced thereby.

Insulated plates 60 and 61 are secured to the bottom surface 34 of the cavity 28. The insulated plates 60 and 61 each comprise a pair of inlet terminals 60*i*1, 60*i*2 and 61*i*1 61*i*2, respectively, each of these terminals being paired up with a corresponding outlet jack, 60*j*1, 60*j*2, 61*j*1 and 61*j*2, respectively. In the preferred embodiment, the inlet terminals consist in wire squeezing bolt and housing assemblies for receiving the free ends of the electrical wire, whereas the outlet jacks consist in banana jacks. According to the requirements of the flame detecting apparatus, the amount of inlet terminal/output jack combinations can be increased or reduced.

Referring now to FIGS. 2 to 4, the detachable member is generally shown at 14. The detachable member 14 is comprised of an annular cap 14*a* assembled with a cylindrical receptacle 14*b*, such as to define a cylindrical body having a front surface 68, a rear surface 70 and a peripheral surface 72. The front surface 68 is partly defined by the annular cap 14*a*, and thus has a sight hole 74*a* concentrically disposed therein. The rear surface 70 is a part of the cylindrical receptacle 14*b*, and has a hole 74*b* concentrically located therein. Consequently, it is possible to see through the detachable member 14 by aligning one's vision with the holes 74*a* and 74*b*. The holes 74*a* and 74*b* are each equipped with a sight wall, namely, 76*a* and 76*b*, respectively, sealingly mounted therein. The sight may consist in transparent or translucent materials, such as glass, polymers or the like.

As it is formed by the mating of the annular cap 14*a* and the cylindrical receptacle 14*b*, the detachable member 14 is hollow and has an inner cavity, such as to enclose electrical components therein. The annular cap 14*a* and the cylindrical receptacle 14*b* are releasably assembled using known methods. For instance, the cap 14*a* may be interference fitted to the receptacle 14*b*. Also, the use of sealing components such as various seals and O-rings may serve for sealingly securing the cap to the receptacle.

Apertures 78 and 79 are defined in the annular cap 14*a* and extend therethrough. Insulated plates 80 and 81 are secured in the apertures 78 and 79, respectively, such as to be planar with the front surface 68. Clips 80*c*1 and 80*c*2 are located on the insulated plate 80 and project outwardly from the front surface 68. Similarly, clips 81*c*1 and 81*c*2 are located on the insulated plate 81 and project outwardly from the front surface 68. The clips are adapted for engaging an electrical connection with the jacks of the fixed member 12, as will be explained hereinafter. Consequently, in the preferred embodiment, the clips consist in banana clips. The opposed ends of the clips extend through the insulated plates 80 and 81 to reach the cavity of the detachable member 14, such as to be connected with electrical components enclosed therein.

The electrical components disposed in the detachable member 14 may comprise various parts (e.g. microcontroller, wires) in accordance with the requirements of the flame detecting apparatus. In the preferred embodiment depicted in FIG. 2, a sensor 82 is disposed in a hole 84 of an insulated plate 86 such as to be oriented toward the front surface 68. Electric connections are made between the sensor 82 and the various components in the cavity. The insulated plate 86 is positioned such that the center of its hole 84 is aligned with the centers of the holes 74*a* and 74*b* of the front surface 68 and the rear surface 70, respectively. As a result, as seen in FIG. 2, it is possible to see through the detachable member 14 with the sensor 82 disposed therein. The sensor 82 is enclosed by screens 87, to be protected from electro-magnetic impulses emanating from the furnace. It is pointed out that other devices may be used for protection against electro-magnetic impulses, such as conductive transparent layers, bearing in mind that these devices must not block the sight holes 74*a* and 74*b*.

The front surface 68 has a shoulder 88 on its periphery. A pair of holes 90*a* and 90*b* extend from the shoulder 88 of the front surface 68 to the rear surface 70. An alignment hole 92 is defined in the front surface 68, adjacent the shoulder 88.

The fixed member 12 is permanently mounted a pivotable sight hole tube F of a furnace using known fastening mechanisms. For instance, the sight hole 24 of the fixed member 12 may be tapped if the tube F of the furnace is threaded. The sight hole 24 of the fixed member 12 is aligned with the sight hole of the furnace. Furthermore, the fixed member 12 is electrically connected to the controls of the furnace, and the inlet terminals are wired accordingly.

The fixed member 12 and the detachable member 14 are assembled by the front surface 68 of the detachable member 14 being disposed on the rear surface 20 of the fixed member 12 while aligning the alignment pin 52 of the fixed member 12 with the alignment hole 92 of the detachable member 14. The flange 48 of the fixed member 12 and the shoulder 88 of the detachable member 14 are sized such that the fixed member 12 and the detachable member 14 are matingly engaged together, with portions of the front surface 68 of the detachable member 14 and the rear surface 20 of the fixed member 12 engaging a planar relationship. Furthermore, the fixed member 12 and the detachable member 14 are aligned by the alignment pin 52 and the alignment hole 92 also being matingly engaged. This alignment ensures that the clips 80*c*1, 80*c*2, 81*c*1 and 81*c*2 are received in the corresponding jacks 60*j*1, 60*j*2, 61*j*1 and 61*j*2, respectively, whereby the detachable member 14 becomes electrically connected.

Furthermore, the center of the sight hole 24 of the fixed member 12 and the centers of the holes 74*a*, 74*b* and 84 of the detachable member 14 are all aligned. Thus, it is possible to see the flame even when the flame detecting apparatus of the present invention is installed and operating, whereby the apparatus may be aligned with the flame by pivoting the sight hole tube F of the furnace and visual inspection of the flame is possible.

Fasteners such as bolts, screws and quick coupling elements may be used to secure the fixed member 12 to the detachable member 14, by operatingly engaging them in the tapped holes 50*a* and 50*b* of the fixed member 12 through the holes 90*a* and 90*b* of the detachable member 14, respectively, as these are correspondingly centered as a result of the mating engagement of the alignment pin 52/alignment hole 92. Snap-fitting engagement between the fixed member 12 and the detachable member 14 may also be provided to ensure the connection therebetween.

To remove the detachable member 14, the above described steps are reversed. The fasteners operatingly engaged in the tapped holes 50*a* and 50*b* are removed. Thereafter, the detachable member 14 is pulled off the fixed member 12, whereby it becomes disconnected, whereas the fixed member 12 remains wired. Consequently, a new detachable member 14 can be installed or the removed detachable member 14 can be repaired.

The sensor 82 is inside the detachable member 14 and oriented toward the flame, whereby external light coming from the hole 74*b* through the sight wall 76*b* does not affect the sensor 82. When the detachable member 14 is removed from the fixed member 12, the sensor 82 becomes electrically disconnected, whereby it ceases to operate and does not detect external light. On the other hand, the sensor 82 may be appropriately chosen so as to be responsive to a specific infrared portion of the electromagnetic spectrum and the sight walls 76*a* and 76*b* may include filters.

The compressed air injected through the conduit 54 is directed toward the furnace as the front surface 68 of the detachable member 14 and the rear surface 20 of the fixed member 12 are co-planar. The front surface 68 is seated on the top of the sight hole wall 46, whereby that end of the sight hole 24 is sealed. Consequently, the air flowing through the sight hole of the furnace prevents the heat from flowing outwardly therefrom. As the sight glass 76*a* of the detachable member 14 may emit infrared radiation, it must not be exposed to the heat flow of the furnace through the sight hole thereof, wherefore the air injection is used. It is pointed out that the air injection may also be provided on the furnace tube F, in which case the conduit 54 is not required on the flame detecting apparatus.

What is claimed is:

1. An apparatus for flameout detection to be used with a furnace having a sight hole tube for flame inspection, said apparatus comprising a body adapted for being mounted to the tube, said body having a sensor device being positioned opposite a sight hole of the sight hole tube for flameout detection and having a see-through portion for flame visibility through said apparatus.

2. The apparatus according to claim 1, wherein said see-through portion is defined by a channel extending through said body and transparent walls disposed in said channel, said sensor device being enclosed in said channel between said transparent walls.

3. The apparatus according to claim 1, wherein a conduit is provided in said body for injecting cooling air in the sight hole of the furnace, thereby protecting said apparatus from furnace heat exposure through the sight hole.

4. The apparatus according to claim 1, wherein said sensor device is protected against electro-magnetic impulses emanating from the furnace by a see-through shield.

5. The apparatus according to claim 4, wherein said see-through shield is defined by a conductive screen.

6. An apparatus for flameout detection to be used with a furnace having a sight hole tube for inspection of a flame, said apparatus comprising:

a fixed portion adapted for being mounted to the sight hole tube and being electrically connected to a control system, said fixed portion defining a first see-through portion being positioned opposite a sight hole of the sight hole tube, whereby the flame is visible therethrough; and a detachable portion having a sensor device therein and being releasably mounted to said fixed portion such as to engage a contact connection therewith, said sensor device being disposed opposite said first see-through portion of said fixed portion for flameout detection therethrough, wherein said detachable portion is electrically disconnected upon being detached from said fixed portion.

7. The apparatus according to claim 6, wherein a conduit is provided in said fixed portion for injecting air in the sight hole of the furnace, thereby protecting said apparatus from furnace heat exposure through the sight hole, said fixed portion being adapted for securing a free end of an air conduit.

8. The apparatus according to claim 7, wherein said sensor device is disposed in a second see-through portion in said detachable portion, whereby said first see-through portion of said fixed portion and said second see-through portion of said detachable portion are superposed such that the flame is visible through said apparatus.

9. The apparatus according to claim 8, wherein said first see-through portion is defined by a first channel extending through said fixed portion, said second see-through portion is defined by a second channel extending through said detachable portion and transparent walls being disposed in said second channel, said sensor device being enclosed in said second channel between said transparent walls.

10. The apparatus according to claim 7, wherein said sensor device is protected against electro-magnetic impulses emanating from the furnace by a see-through shield.

11. The apparatus according to claim 10, wherein said see-through shield is defined by a conductive screen.

12. The apparatus according to claim 7, wherein said contact connection between said fixed portion and said detachable portion consists of corresponding banana clips and banana jacks.

13. The apparatus according to claim 7, wherein said fixed portion and said detachable portion comprise corresponding alignment guides, to ensure the contact connection therebetween.

14. A method for installing a flameout detection apparatus to a sight hole tube of a furnace and replacing said flameout detection apparatus, said method comprising the steps of:

(i) securing a fixed portion of said flameout detection apparatus to the sight hole tube of the furnace;

(ii) wiring said fixed portion of said flameout detection apparatus to a control system;

(iii) electrically connecting a detachable sensor portion of said flameout detection apparatus by securing same to said fixed portion;

(iv) when said detachable sensor portion requires to be replaced, disconnecting said detachable sensor portion by detaching same from said fixed portion; and (v) repeating step (iii) with one of said detachable sensor portion having been repaired and another detachable sensor portion.

15. The method according to claim 14, wherein said steps (iv) and (v) are repeated when said detachable sensor portion needs to be replaced at a later time.

16. The method according to claim 15, wherein said step (ii) includes securing an air conduit to said fixed portion of said apparatus, for injecting air therein for protecting said apparatus from furnace heat exposure through the sight hole tube.

* * * * *